US007422490B2

(12) United States Patent
Droesbeke et al.

(10) Patent No.: US 7,422,490 B2
(45) Date of Patent: Sep. 9, 2008

(54) CONNECTOR, CONNECTOR ASSEMBLING SYSTEM AND METHOD OF ASSEMBLING A CONNECTOR

(75) Inventors: Gert Droesbeke, Geel (BE); Erik Derks, Schijndel (NL)

(73) Assignee: FCI, Versailles (FR)

( * ) Notice: Subject to any disclaimer, the term of this patent is extended or adjusted under 35 U.S.C. 154(b) by 0 days.

(21) Appl. No.: 11/630,292

(22) PCT Filed: Jun. 20, 2005

(86) PCT No.: PCT/EP2005/006621

§ 371 (c)(1),
(2), (4) Date: Dec. 19, 2006

(87) PCT Pub. No.: WO2006/002793

PCT Pub. Date: Jan. 12, 2006

(65) Prior Publication Data

US 2008/0026642 A1 Jan. 31, 2008

(30) Foreign Application Priority Data

Jun. 25, 2004 (NL) ..... 1026502

(51) Int. Cl.
*H01R 13/502* (2006.01)

(52) U.S. Cl. ..... 439/701

(58) Field of Classification Search ..... 439/701, 439/608, 78, 715, 717
See application file for complete search history.

(56) References Cited

U.S. PATENT DOCUMENTS 3,325,771 A * 6/1967 Ruehlemann et al. ..... 439/681
4,984,992 A * 1/1991 Beamenderfer et al. ..... 439/108
5,312,276 A * 5/1994 Hnatuck et al. ..... 439/681
5,368,505 A * 11/1994 Hoolhorst et al. ..... 439/701
5,387,130 A * 2/1995 Fedder et al. ..... 439/610
5,525,066 A * 6/1996 Morlion et al. ..... 439/108
5,554,038 A * 9/1996 Morlion et al. ..... 439/108
5,573,416 A * 11/1996 Morlion et al. ..... 439/291
5,634,822 A 6/1997 Gunell ..... 439/668
5,997,361 A * 12/1999 Driscoll et al. ..... 439/701
6,352,452 B1 * 3/2002 Jimenez et al. ..... 439/680
6,361,374 B1 * 3/2002 Lloyd et al. ..... 439/701
6,371,788 B1 * 4/2002 Bowling et al. ..... 439/358
6,503,108 B1 * 1/2003 Kikuchi et al. ..... 439/680
6,652,318 B1 11/2003 Winings et al. ..... 439/608
6,666,719 B1 * 12/2003 Kuroi et al. ..... 439/607

(Continued)

FOREIGN PATENT DOCUMENTS

NL 1 019 122 6/2003

(Continued)

*Primary Examiner*—Tulsidas C. Patel
*Assistant Examiner*—Vladimir Imas
(74) *Attorney, Agent, or Firm*—Harrington & Smith, PC

(57) ABSTRACT

A connector is described which includes a plurality of connector wafers coupled by a coupling piece. Each connector wafer includes a housing accommodating a column of contact elements. The housing has opposite side edges, an insertion side with apertures allowing access to the contact elements, a back side, and opposite main faces. The coupling piece is provided with coupling means for each connector wafer engaging corresponding coupling means of a connector wafer. Each coupling means of the coupling piece engaging a connector wafer is offset from an adjacent coupling means engaging an adjacent connector wafer to provide offset columns of contact elements.

19 Claims, 7 Drawing Sheets

U.S. PATENT DOCUMENTS 6,692,305 B2 * 2/2004 Nelson et al. ..... 439/608
6,739,910 B1 * 5/2004 Wu ..... 439/608
6,773,305 B2 * 8/2004 Wu ..... 439/608
6,814,620 B1 * 11/2004 Wu ..... 439/608
6,837,720 B2 * 1/2005 Hicks et al. ..... 439/79
6,848,932 B2 * 2/2005 Bowling et al. ..... 439/358
2004/0077228 A1 * 4/2004 Wu ..... 439/701
2004/0259420 A1 * 12/2004 Wu ..... 439/608
2004/0266273 A1 * 12/2004 Wu ..... 439/701

FOREIGN PATENT DOCUMENTS

WO WO-04/001907 A1 12/2003

* cited by examiner

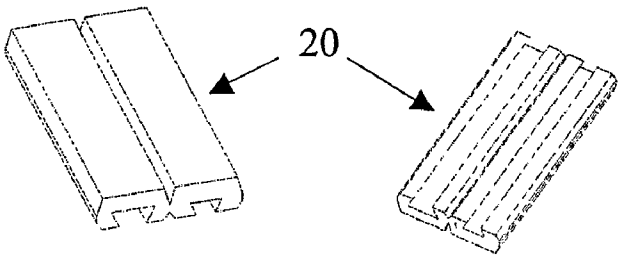
Fig. 6A
Fig. 6B
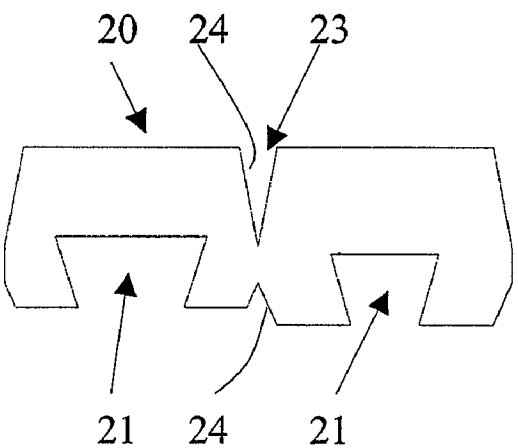
Fig. 6C
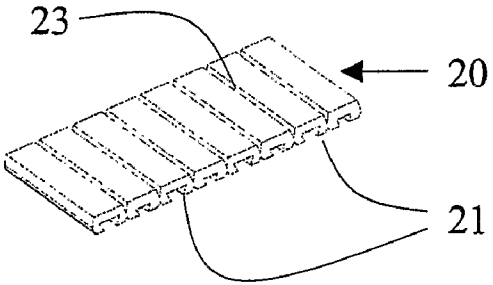
Fig. 5
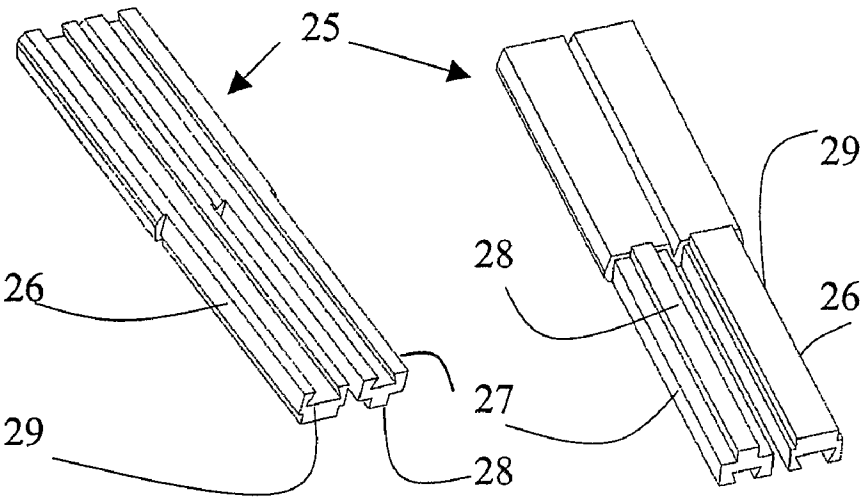
Fig. 7B
Fig. 7A

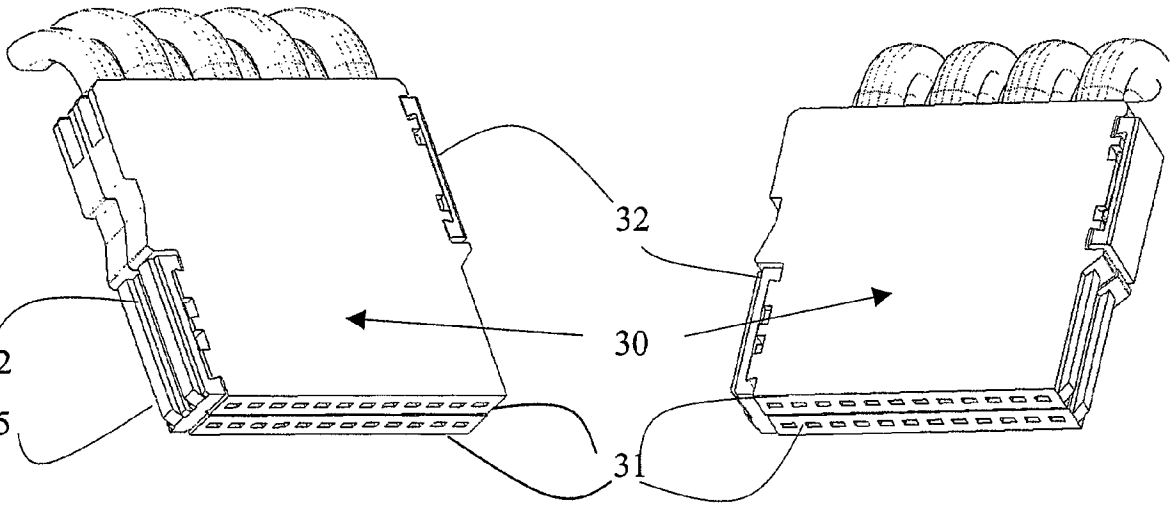
Fig. 8A
Fig. 8B
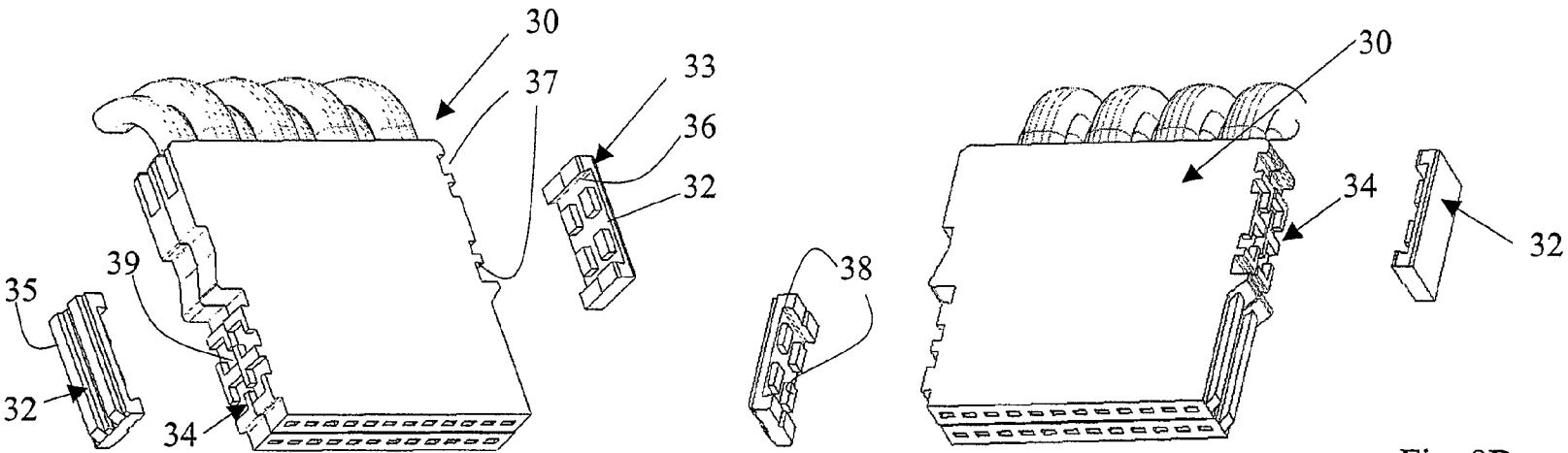
Fig. 9A
Fig. 9B

CONNECTOR, CONNECTOR ASSEMBLING SYSTEM AND METHOD OF ASSEMBLING A CONNECTOR

FIELD OF THE INVENTION

The invention relates to a connector, comprising a plurality of connector wafers coupled by a coupling piece, each connector wafer comprising a housing accommodating a column of contact elements, said housing having opposite side edges, an insertion side with apertures allowing access to the contact elements, a back side, and opposite main faces, wherein said coupling piece is provided with coupling means for each connector wafer engaging corresponding coupling means of a connector wafer, to a connector assembling system and to a method of assembling a connector.

BACKGROUND OF THE INVENTION

A connector of this type is shown in NL-C-1 019 122. In this known connector the contact elements of successive columns of contact elements are aligned. In connectors of this type to be used in high speed applications, it is desired to reduce cross-talk. According to U.S. Pat. No. 6,652,318 cross-talk can be reduced by providing an offset between adjacent columns of contact elements.

SUMMARY OF THE INVENTION

The object of the invention is to provide a connector of the above mentioned type with improved high speed performance.

According to the invention each coupling means of the coupling piece engaging a connector wafer is offset from an adjacent coupling means engaging an adjacent connector wafer to provide offset columns of contact elements.

In this manner a connector is provided in which offset columns of contact elements are obtained in an easy manner as the connector wafers are accurately positioned according to the offset provided between the successive coupling means of the coupling piece.

In a preferred embodiment the coupling means of the connector wafers are provided as a coupling ridge on one or both side edges of the connector wafer extending in a direction from the back side to the insertion side, and wherein the coupling means of the coupling piece are provided as coupling slots adapted to receive a connector wafer coupling ridge, said slots and ridges having preferably a dovetail-shaped cross-section. In this manner an accurate alignment of the connector wafers is obtained as the coupling ridges and coupling slots co-operate along a relatively high alignment length.

According to the invention the coupling piece can be extended up to the insertion side of the connector wafers, wherein the coupling piece outer side is provided with polarisation elements and/or coding elements at its insertion end. In this manner each connector can be provided with polarisation and/or coding elements as desired and it is even possible to change the polarisation and/or coding after completion of the connector.

It is advantageous if said coupling piece is provided with breaking locations in between offset coupling means. In this manner manufacturing of the connector of the invention is simplified as only one coupling piece can be used to assemble a connector with a desired number of connector wafers by breaking the coupling piece to the required length.

Generally, the connector is designed to have a number of differential contact element pairs with ground contact elements in between differential contact element pairs. As shown in U.S. Pat. No. 6,652,318 the order of differential signal contact element pairs and ground contact elements is changed in successive connector wafers. According to the invention it can be guaranteed during manufacturing that the correct connector wafers are mounted adjacent one another by providing said coupling piece at its side with offset coupling means with polarisation means cooperating with polarisation means of said connector wafers. These polarisation means can be obtained in a simple manner in an advantageous embodiment of the invention if said polarisation means of coupling piece and connector wafers are made as said coupling slots and coupling ridges having different sizes.

According to another aspect of the invention a connector is provided, the connector comprising a housing with a bottom and opposite upstanding side walls determining a receiving space for receiving a connector, said bottom wall accommodating a plurality of columns of contact elements, wherein at least one of the side walls is provided with polarisation and/or coding means, characterized in that the polarisation and/or coding means are part of at least one polarisation piece detachably mounted in the housing adjacent the corresponding side wall.

The invention further provides a connector assembling system for assembling a connector, comprising connector wafers and coupling pieces with a maximum number of successive offset coupling means, wherein the coupling piece is provided with breaking locations in between offset coupling means to allow assembly of connectors with a varying number of columns of contact elements.

Further, the invention provides a method of assembling a connector, said method comprising providing a plurality of connector wafers, each connector wafer having a housing with opposite side edges, at least one edge having coupling means, providing a coupling piece having a number of successive coupling means, and coupling a desired number of connector wafers by means of at least one coupling piece. According to the invention the coupling piece is provided with successive offset coupling means for engaging coupling means of successive connector wafers, wherein adjacent connector wafers are positioned offset by interconnecting the connector wafers by means of the coupling piece.

BRIEF DESCRIPTION OF THE DRAWINGS

The invention will be further explained by reference to the drawings in which some embodiments of the connector of the invention are schematically shown.

FIG. 5 shows a coupling piece as used in the connectors shown in FIGS. 2-4.

FIGS. 6A-6C show different views of the coupling piece used in the connector of FIG. 2A.

FIG. 7 shows a different embodiment of the coupling piece as can be used in the connector of the invention.

FIGS. 8-9 show different embodiments of the connector of the invention with different embodiments of the coupling piece.

DETAILED DESCRIPTION OF THE INVENTION

Figure 2B:
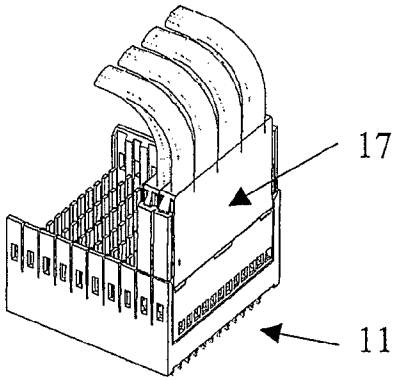
FIGS. 2-4 show three different embodiments of the connector of the invention with different numbers of connector wafers.
Figure 2A:
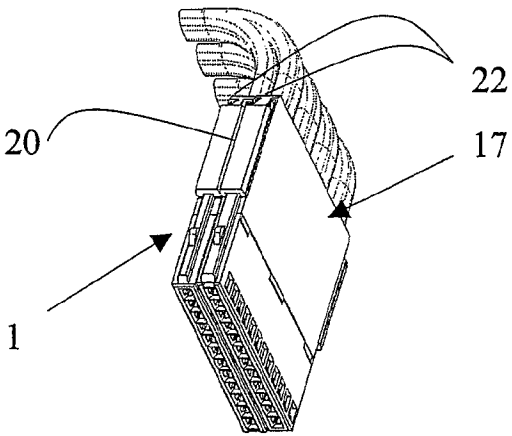
Figure 1B:
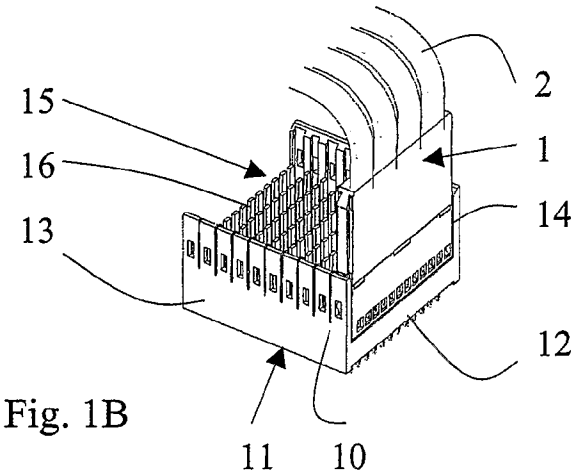
FIG. 1 shows by way of example one connector wafer as used in the connector of the invention.
Figure 1A:
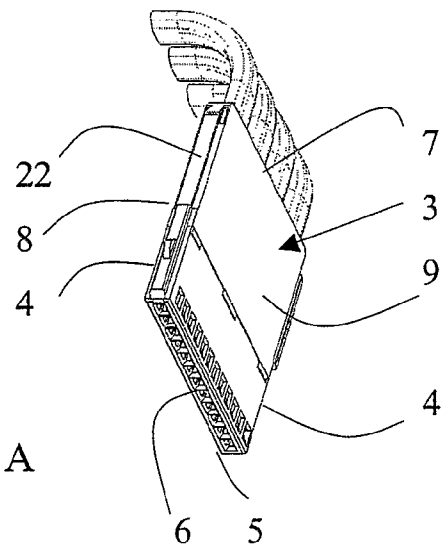
Figure 3B:
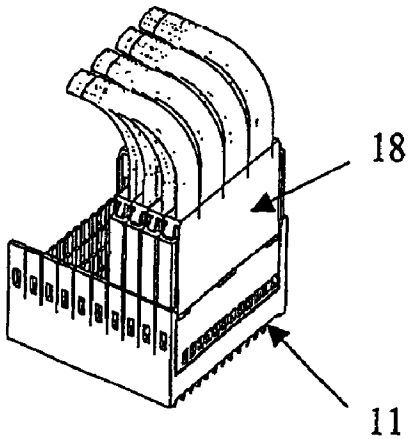
Figure 3A:
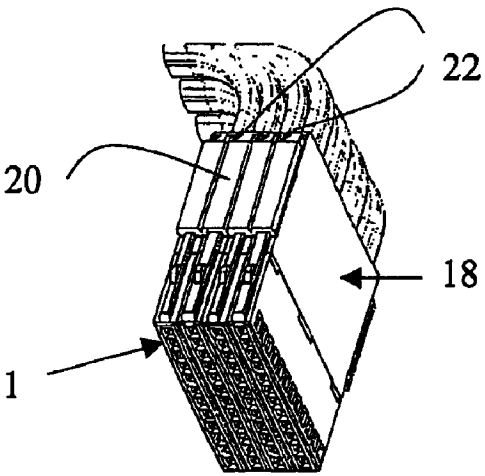
Figure 4B:
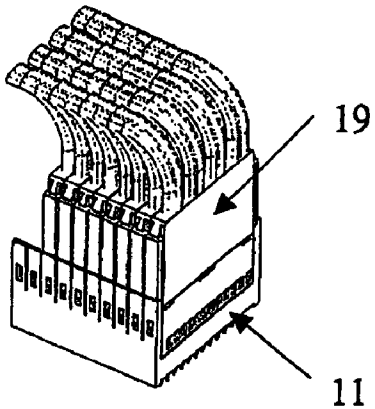
Figure 4A:
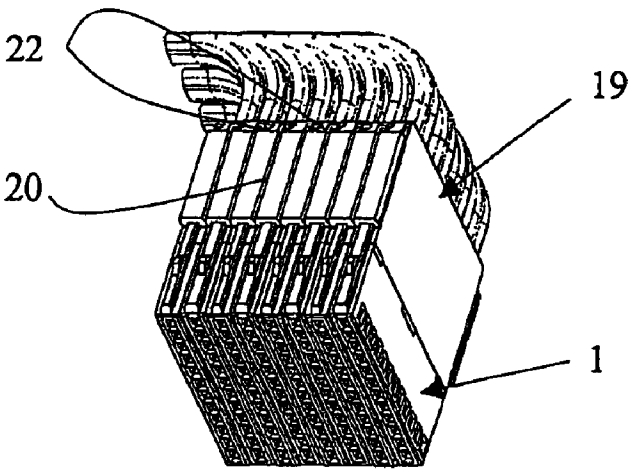

FIGS. 1A and 1B show by way of example a connector wafer 1 which is used to assemble different embodiments of the connector of the invention as shown in FIGS. 2-4. As shown the connector wafer 1 is adapted to be used as a connector wafer for a cable connector accommodating in this example four cables 2, each cable 2 having a differential pair of signal conductors and one or two ground conductors not further shown. The signal conductors and ground conductors are connected to contact elements accommodated in a housing 3 of the connector wafer 1. The housing 3 has opposite side edges 4, an insertion side 5 with apertures 6 allowing access to the contact elements accommodated in the housing 3. Further the housing has a backside 7 and opposite main faces 8,9. The cables 2 are introduced into the housing 3 from the backside 7. As can be seen in FIG. 1B, the connector wafer 1 can be used on its own as cable connector and can be introduced into the housing 10 of a second connector 11 which can be mounted on a printed circuit board not further shown. The second housing 11 comprises a bottom wall 12 and two opposite upstanding sidewalls 13,14 determining a receiving space 15 in which a number of contact elements 16 can be seen. The connector wafer 1 can be inserted into the receiving space 15 with its insertion side 5 to interconnect the contact elements of the connector wafer 1 and the connector elements 16 of the second connector 11.

FIGS. 2-4 show three different connectors 17,18 and 19 as embodiments of the connector of the invention. The connectors 17-19 comprise two, four, and eight connector wafers 1, respectively. The connector wafers 1 are coupled or interconnected at both side edges 4 by coupling pieces 20 having a different length in the embodiments of FIGS. 2, 3 and 4, respectively. It is possible to use one coupling piece 20 at one side edge only. However it is preferred to use coupling pieces at both side edges. As shown in FIGS. 2B-4B, the connectors 17-19 can be inserted into a second connector 11, wherein the construction and pitch of the connector wafers 1 in the connector 17-19 is such that two or more connectors 17-19 can be inserted into one second connector 11.

FIGS. 6A-6C show different views of the coupling piece 20 of the connector 17 shown in FIG. 2. This coupling piece comprises two adjacent coupling means 21 co-operating with corresponding coupling means 22 of a connector wafer 1. In this embodiment the coupling means 21 of the coupling means 20 are made as coupling slots with a dovetail-shaped cross-section as can be seen in FIGS. 6A-6C. The coupling means 22 of the connector wafers 1 are made as coupling ridges on both side edges 4 and these coupling ridges 22 have a corresponding dovetail-shaped cross-section so that a firm interconnection between the coupling pieces 20 and the connector wafers 1 is provided. The coupling pieces 20 can be slid in the connector wafers 1 from the backside towards the insertion side or vice versa. In view of the longitudinal shape of the coupling slots 21 and coupling ridges 22, relatively long co-operating surfaces of slots 21 and ridges 22 are obtained providing an accurate alignment of the connector wafers 1. As can be seen in FIG. 6C in particular, the left coupling slot 21 is offset from the adjacent coupling slot 21 so that the adjacent connector wafers 1 are positioned offset and in this manner each column of contact elements is offset from an adjacent column of contact elements. As explained in U.S. Pat. No. 6,652,318 cross-talk can be reduced in this manner. For a further explanation reference is made to this document. The present invention relates to providing a coupling piece 20 with adjacent coupling means 21, wherein each coupling means 21 is offset from an adjacent coupling means 21. In this manner manufacturing a connector with a desired number of connector wafers 1, wherein each connector wafer 1 is offset from an adjacent connector wafer 1, thereby providing offset adjacent columns of contact elements, is relatively simple.

With the connector assembling system of the invention it is relatively easy to assemble a connector with any desired number of connector wafers 1. In FIG. 5 a standard coupling piece 20 is shown having eight successive coupling slots 21 which coupling slots just as in the coupling piece of FIG. 6 are provided in an offset manner so that each coupling slot 21 is offset from an adjacent coupling slot 21. If a connector 18 with four connector wafers 1 has to be assembled, the coupling piece 20 of FIG. 5 is broken in two parts, each part having four coupling slots 21. In the same manner a coupling piece with two up to seven coupling slots 21 can be obtained by removing one up to six coupling slots 21. Removing a part of the coupling piece 20 of FIG. 5 is facilitated by providing breaking locations 23 in between each two offset coupling slots 21. As can be seen in FIGS. 5 and 6, a breaking location 23 is obtained by two opposite grooves 24 which are preferably V-shaped. If desired a coupling piece with breaking locations can be provided with non-offset coupling means so that the columns of contact elements of the coupled connector wafers will be aligned in a usual manner.

In the embodiments shown in FIGS. 2-4, all connectors 17-19 have the same column pitch in such a manner that the facing main faces 8, 9 of adjacent connector wafers 1 are contacting each other. In the connector assembling system of the invention it is possible to manufacture a connector with a different column pitch using the same connector wafers 1. To this end a different coupling piece 20 can be provided having a different pitch of adjacent coupling slots 21. As the pitch of the coupling slots 21 determines the column pitch of the assembled connector, connectors with any desired column pitch can be manufactured by providing suitable coupling pieces 20.

As shown in FIGS. 5 and 6, the coupling slots provide for a polarisation/coding of adjacent connector wafers as the left-hand slot 21 has a different size as the right-hand slot 21. In this manner it can be guaranteed that adjacent connector wafers 1 are used having a different order of signal and ground contact elements as described in U.S. Pat. No. 6,652,318.

The coupling piece 20 according to the invention allows the use of extended coupling pieces, i.e. a coupling piece which extends substantially from the backside 7 up to the insertion side 5 of the connector wafers 1. By way of example FIGS. 7A and 7B show a coupling piece 25 having such extensions 26,27, wherein the coupling slots 21 extend along the full length of the coupling piece 25. Moreover, in this manner the extensions 26,27 can be provided with polarisation and coding elements 28,29. By providing coupling pieces 25 with different polarisation and coding elements 28,29, connectors can be manufactured with any desired type of polarisation and coding elements. Further, it is possible to change the polarisation/coding elements of a connector even after completion of the connector.

FIGS. 8 and 9 show a different embodiment of the connector of the invention indicated with reference numeral 30. This connector 30 comprises two connector wafers 31 which are mainly made in the same manner as the connector wafers 1. The connector wafers 31 are interconnected by two coupling pieces 32 having adjacent offset coupling means 33 co-operating with corresponding coupling means 34 provided on the opposite side edges 4 of the connector wafers 31. FIGS. 8A and 8B show the assembled connector 30, whereas in FIGS. 9A and 9B the coupling pieces 32 are shown separated from the connector wafers 31. As can be seen in FIGS. 8A and 9A in particular, the coupling pieces 32 located close to the insertion side 5 of the connector wafers 31 are provided with polarisation/coding elements 35.

In the embodiment of FIGS. 8, 9, the coupling piece 32 is mounted on the connector wafers 31 by snapping/clicking the coupling piece onto the connector wafers 31 instead of sliding as in the above-described embodiments. The coupling means 33 of the coupling piece 32 comprises dovetail edges 36 co-operating with corresponding dovetail edges 37 of the coupling means of the connector wafers 31. Further alignment protrusions 38 are provided on the coupling piece 32 co-operating with alignment recesses 39 of the connector wafers 31.

Figure 10:
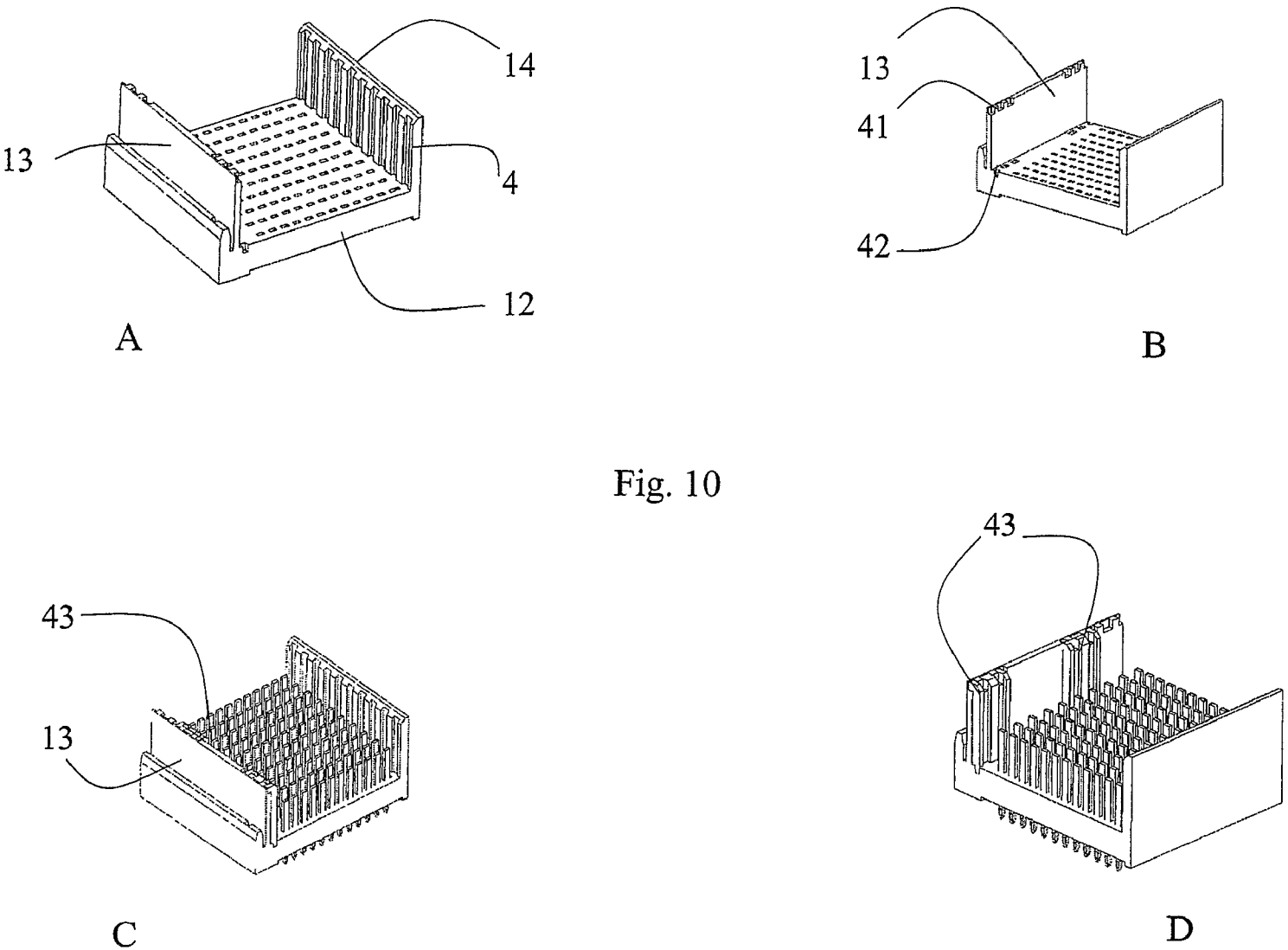
FIG. 10A-10D show different views of a further embodiment of a connector of the invention.

FIGS. 10A-10D show a second connector according to the invention indicated by reference numeral 40. In the same manner as connector 11 shown in FIGS. 1-4, connector 40 comprises a bottom wall 12 and opposite upstanding sidewalls 13,14. In this case upstanding sidewall 13 is a flat sidewall having mounting recesses 41 at its upper side and adjacent mounting recesses 42 in the bottom wall 12. In this manner polarisation/coding elements 43 can be mounted adjacent to the sidewall 13 as schematically shown in FIGS. 10C and 10D. The detachably mounted polarisation/coding elements allow to assemble a connector 40 with any desired type of polarisation/coding by providing suitable elements 43.

Figure 12:
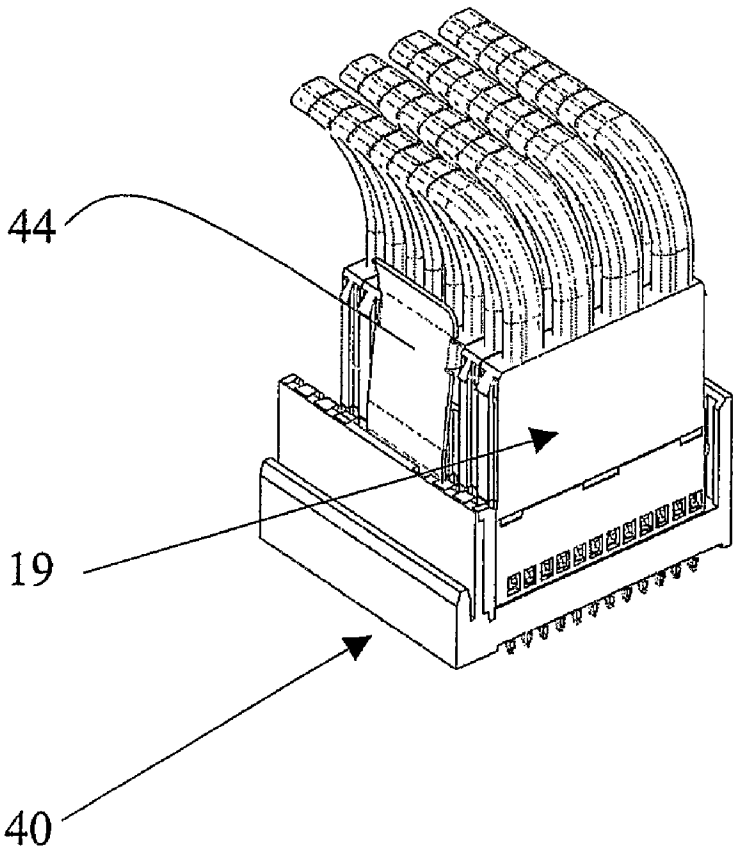
FIGS. 11 and 12 show different views of a connector assembly of embodiments of the connectors of the invention.
Figure 11:
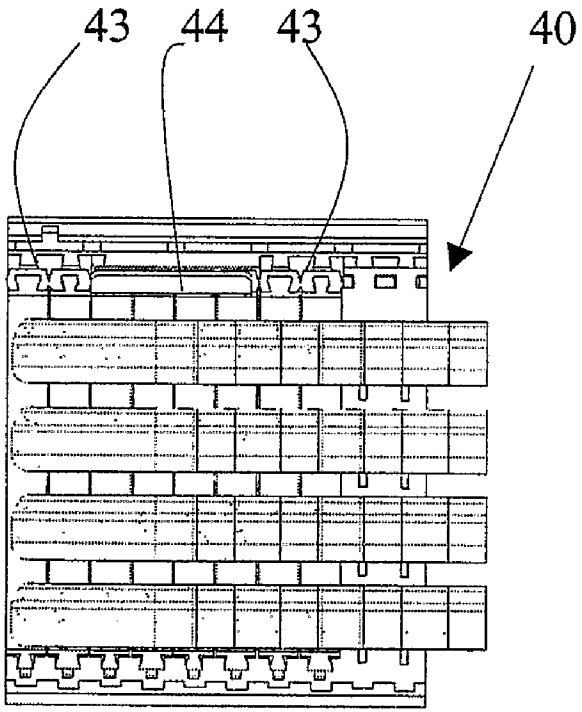

FIGS. 11 and 12 show an embodiment of the connector 40 with two polarisation/coding elements 43 and a connector 19 inserted into the connector 40. In a manner not further shown a latching element 44 is mounted in between the two coding elements 43 to provide an active latching of the connector 19 in the connector 40. The connector 40 with latching element 43 is further described in a co-pending patent application of the same applicant with the same filing date. For a further description reference is made to this co-pending application.

Figure 13B:
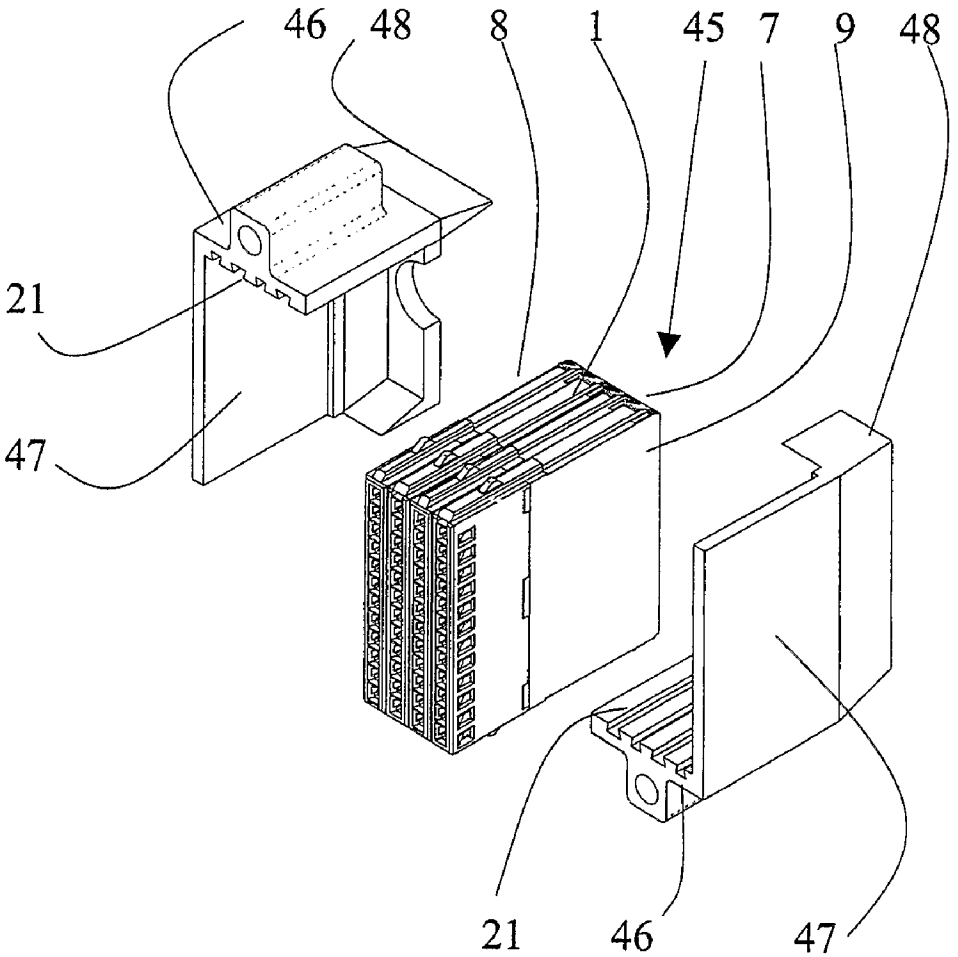
FIGS. 13A and 13B show a further embodiment of the connector according to the invention.
Figure 13A:
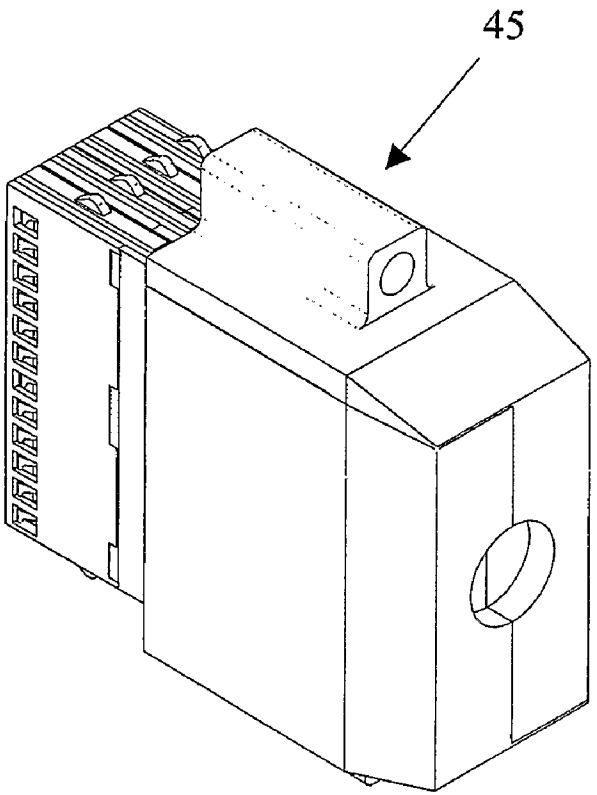

FIGS. 13A and 13B show a further embodiment of the connector of the invention indicated by reference numeral 45. FIG. 13A shows the connector 45 as assembled, however without cables, and FIG. 13B shows the connector wafers 1 separately from the two coupling pieces 46 used. The coupling pieces 46 each are provided with the same coupling slots 21 as the coupling piece 20 provided in an offset manner and having different sizes as described above. In this case the coupling pieces 46 are provided with cover parts 47 and 48 enclosing the main faces 8,9 and the backside 7 of the connector wafers 1. This embodiment shows that the design of the coupling piece 20 shown in FIGS. 5 and 6 allows the coupling piece to be provided with further parts to complete the connector in any desired manner.

The invention is not restricted to the above-described embodiments which can be varied in a number of ways within the scope of the following claims.

The invention claimed is:

1. Connector, comprising a plurality of connector wafers coupled by a coupling piece, each connector wafer comprising a housing accommodating a column of contact elements, said housing having opposite side edges, an insertion side with apertures allowing access to the contact elements, a back side, and opposite main faces, wherein said coupling piece is provided with coupling means for each connector wafer engaging corresponding coupling means on a first one of the side edges of one of the connector wafers, characterized in that each coupling means of the coupling piece engaging a connector wafer is offset from an adjacent coupling means engaging an adjacent connector wafer to provide the first side edges of the adjacent connector wafers as being stepped relative to each other and thereby providing offset columns of contact elements.

2. Connector according to claim 1, wherein the coupling means of the connector wafers are provided as a coupling ridge on one or both side edges of the connector wafer extending in the direction from the insertion side to the back side, and wherein the coupling means of the coupling piece are provided as a coupling slot adapted to receive a connector wafer coupling ridge, the coupling slots and ridges having preferably a dovetail-shaped cross-section.

3. Connector according to claim 2, wherein the coupling piece extends up to the insertion side of the connector wafers, wherein the coupling piece outer side is provided with polarisation elements and/or coding elements at its insertion end.

4. Connector according to claim 3, wherein the coupling ridges and slots extend up to the insertion side of the connector wafers.

5. Connector comprising a plurality of connector wafers coupled by a coupling piece, each connector wafer comprising a housing accommodating a column of contact elements, said housing having opposite side edges, an insertion side with apertures allowing access to the contact elements, a back side, and opposite main faces, wherein said coupling piece is provided with coupling means for each connector wafer engaging corresponding coupling means of a connector wafer, characterized in that each coupling means of the coupling piece engaging a connector wafer is offset from an adjacent coupling means engaging an adjacent connector wafer to provide offset columns of contact elements, wherein said coupling piece is provided with breaking locations in between offset coupling means.

6. Connector according to claim 5, wherein said coupling piece is provided with opposite, preferably V-shaped grooves providing said breaking locations.

7. Connector according to claim 1, wherein said coupling piece at its side with offset coupling means is provided with polarisation means cooperating with polarisation means of said connector wafers.

8. Connector according to claim 7, wherein said polarisation means of coupling piece and connector wafers are made as said coupling slots and coupling ridges having different sizes.

9. Connector according to claim 1, wherein said coupling piece is provided with a cover section enclosing at least a part of the connector main face and/or backside.

10. Connector assembling system for assembling a connector, comprising connector wafers and coupling pieces with a maximum number of successive offset coupling means, wherein the coupling piece is provided with breaking locations in between offset coupling means to allow assembly of connectors with a varying number of columns of contact elements.

11. Connector assembling system for assembling a connector according to claim 10, comprising different coupling pieces with successive offset coupling means spaced at a different pitch to allow assembly of connectors with different column pitches.

12. Method of assembling a connector, comprising:

providing a plurality of connector wafers, each connector wafer having a housing with opposite side edges, at least one edge having coupling means, providing at least one coupling piece having a number of successive coupling means, and coupling a desired number of the connector wafers by means of the at least one coupling piece, characterized in that the successive coupling means are offset relative to adjacent coupling means for engaging coupling means of successive ones of the connector wafers, wherein first ones of the side edges of adjacent connector wafers are positioned by interconnecting the connector wafers by means of the at least one coupling piece in an offset stepped array.

13. Method of assembling a connector, comprising providing a plurality of connector wafers, each connector wafer having a housing with opposite side edges, at least one edge having coupling means, providing a coupling piece having a number of successive coupling means, and coupling a desired number of connector wafers by means of at least one coupling piece, characterized in that the coupling piece is provided with successive offset coupling means for engaging coupling means of successive connector wafers, wherein adjacent connector wafers are positioned offset by interconnecting the connector wafers by means of the coupling piece, wherein the coupling piece has a maximum number of successive offset coupling means separated by breaking locations, wherein the coupling piece is adjusted to the desired number of connector wafers by removing a part of the coupling piece by breaking the coupling piece at a corresponding breaking location.

14. Method according to claim 12, wherein the coupling piece is slid on the desired number of connector wafers in a direction from the connector wafer back side to the connector wafer insertion side.

15. Method according to claim 12, wherein coupling pieces with a different pitch of successive offset coupling pieces are provided and a coupling piece with a desired pitch of the coupling means is selected and slid on a number of connector wafers to obtain a connector with a desired column pitch.

16. An electrical connector comprising:

first and second connector wafers, wherein the connector wafers each comprises a housing and a plurality of contact elements connected to the housing, wherein the contact elements of each connector wafer are aligned with each other in a spaced column between opposite first and second side edges of the housing;

a coupling piece directly connecting the first side edges to each other, wherein the coupling piece is sized and shaped to locate the connector wafers relative to each other with their first side edges in an offset staggered array such that the contact elements of the first housing element are staggered relative to the contact elements of the second housing element.

17. An electrical connector as in claim 16 wherein the coupling piece comprises stepped offset portions which are sized and shaped to receive portions of the first side edges, and wherein the coupling piece is provided with breaking locations in between the stepped offset portions.

18. An electrical connector as in claim 16 wherein the coupling piece comprises first and second offset portions which are stepped relative to a side of the coupling piece located against the first side edges, wherein the first and second offset portions comprise dovetail slots which are sized and shaped to receive portions of the first side edges, and wherein the dovetail slots are stepped relative to each other from the side of the coupling piece located against the first side edges.

19. An electrical connector as in claim 16 wherein the coupling piece comprises first and second offset portions which are stepped relative to each other at a side of the coupling piece located against the first side edges, wherein the first and second offset portions comprise slots which are sized and shaped to receive portions of the first side edges, and wherein the first and second offset portions comprises stepped leading faces forming at least a portion of the side of the coupling piece located against the first side edges.

* * * * *